United States Patent [19]

Lanzani

[11] 4,375,756

[45] Mar. 8, 1983

[54] ICE CUBE MACHINE

[75] Inventor: Emanuele Lanzani, Milan, Italy

[73] Assignee: King-Seeley Thermos Co., Prospect Heights, Ill.

[21] Appl. No.: 311,624

[22] Filed: Oct. 15, 1981

Related U.S. Application Data

[63] Continuation of Ser. No. 105,382, Dec. 17, 1979, abandoned, which is a continuation-in-part of Ser. No. 2,718, Jan. 11, 1979.

[30] Foreign Application Priority Data

Feb. 2, 1978 [IT] Italy ..... 19904 A/78
Jan. 30, 1979 [IT] Italy ..... 19702 A/79

[51] Int. Cl.[3] ..... F25C 1/04
[52] U.S. Cl. ..... 62/347; 239/469
[58] Field of Search ..... 62/73, 74, 347, 352; 239/468, 469 X

[56] References Cited

U.S. PATENT DOCUMENTS

| | | | |
|---|---|---|---|
| 911,716 | 2/1909 | Gibbs | 239/469 X |
| 1,221,945 | 4/1917 | Yonge | 239/469 X |
| 1,465,580 | 8/1923 | Findlay | 239/469 X |
| 1,517,598 | 12/1924 | Stevenson | 239/469 |
| 2,141,077 | 12/1938 | Baker | 239/469 |
| 4,006,605 | 2/1977 | Dickson et al. | 62/347 X |

*Primary Examiner*—William E. Tapolcai
*Attorney, Agent, or Firm*—Harness, Dickey & Pierce

[57] ABSTRACT

An ice cube making machine comprising a plurality of inverted ice forming cups disposed above a water spraying mechanism characterized as having at least two semispherical enclosures to which water is supplied by a pump and is therein caused to circulate in a circular fashion to produce the desired water spray, and also comprising an improved arrangement for ensuring the detachment of the cubes during the "harvest" portion of the cycle.

2 Claims, 14 Drawing Figures

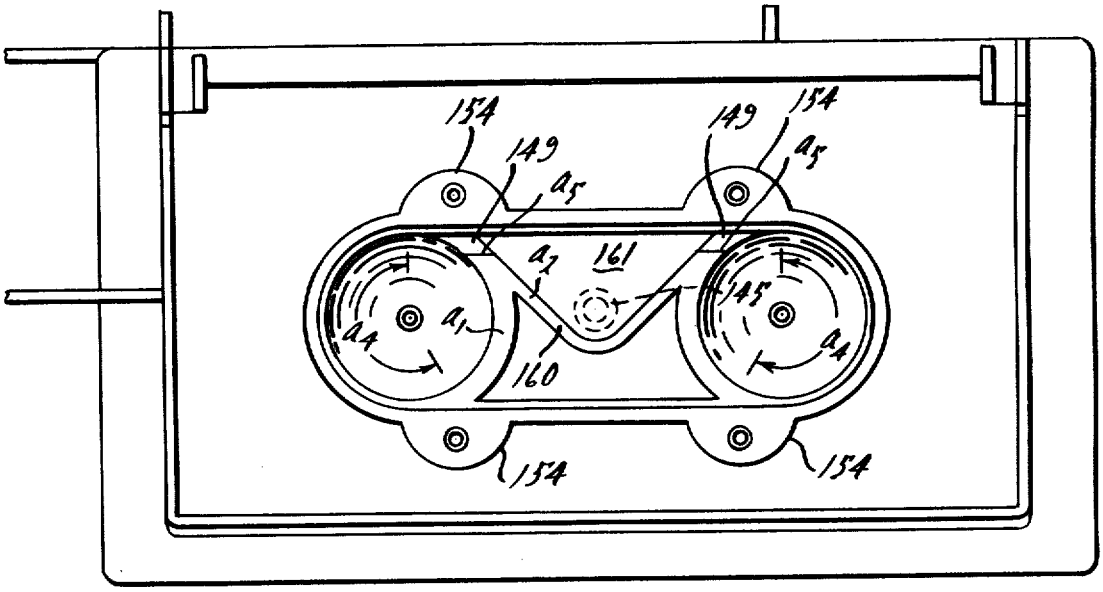
FIG. 12.
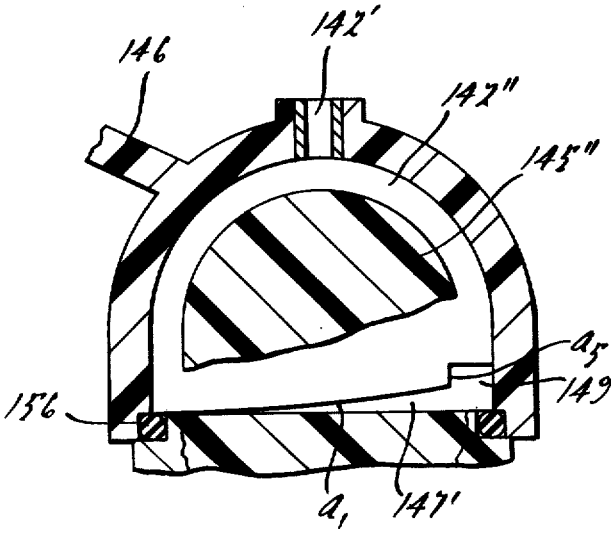
FIG. 14.
FIG. 13.
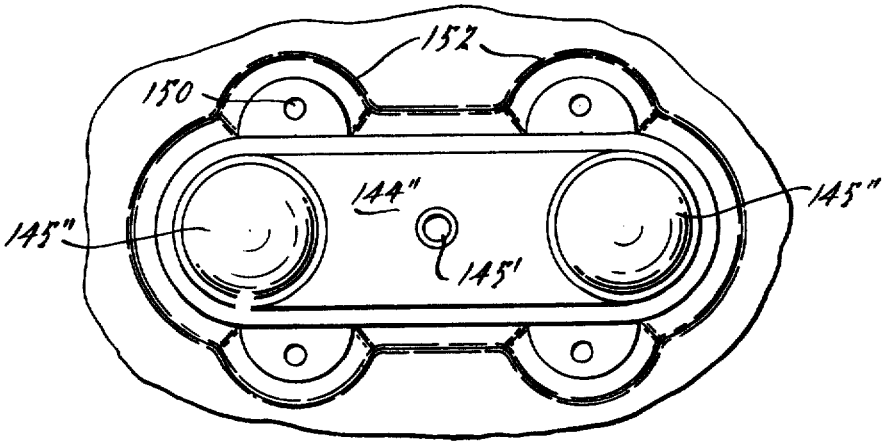

ICE CUBE MACHINE

The present application is a continuation of applicant's prior application Ser. No. 105,382, filed Dec. 17, 1979, now abandoned as a continuation-in-part of applicant's prior application, Ser. No. 2718, filed Jan. 11, 1979 and assigned to the assignee hereof.

BACKGROUND AND SUMMARY OF THE INVENTION

The aforesaid prior application, Ser. No. 2718 provides an automatic machine for the production of ice cubes, independent of any connection with the water system, made especially for household use, offices or small establishments. The improved water spraying mechanism and arrangement for ensuring the detachment of the cubes, claimed in this application are disclosed herein in connection with the machine of the prior application but can as well be used in other type of ice cube machines.

Many types of automatic ice cube machines are known, made to be installed in public places, such as bars, restaurants, hotels and such, capable of a continuous ice cube production: all these machines require a continuous in and outflow of water, their operation depending on a continuous cycle of an influx and discharge flow of water to a refrigerator; the above indicates therefore, the necessity of a connection with the general water system, and therefore the installation of a permanent kind, with resulting sensitive problems for home use, small establishments, offices, caused by the machine themselves.

Consequently, the aim of the invention of the prior application is to furnish an ice cube machine that is completely free and independent of any water connection and that would be inexpensive, so that it could be used as a household appliance, in offices and small establishments.

The automatic machine for making ice cubes, according to the invention of the prior application, has attained these aims because it furnishes a water tank having one compartment able to contain a larger quantity of water than that necessary for one cycle of ice cube production, and a smaller compartment able to contain only the amount of water needed for and during one freezing cycle, connected to the freezing units through means that can produce a continuous cycle of water between the smaller compartment itself and freezing units.

To be more specific, the machine invented is of the kind in which the freezing units are constituted of many small inverted cups connected to an evaporator and overhanging devices able to spray the water to be frozen into said small cups; the above-mentioned water tank is therefore connected to the spraying parts by means of a small duct connected to a pump immersed in the water tank itself, while a small discharge container collects the unfrozen water which is conveyed through a discharge duct, back to the smaller water compartment.

Another characteristic of the invention of the prior application is that, in order to accelerate the cycle of production, the water tank is built in two compartments connected with each other at the bottom by a small opening, one of the parts having a capacity substantially equal to the quantity of water necessary for one or more cycles of production. The emission pump and the small discharge duct are immersed in this compartment, within which, during each cycle of production, a progressive cooling of the water takes place.

The herein claimed spraying devices are furthermore built in such a way as to avoid the clogging of the spray tips through calcium deposits, possible particularly because there is no continous renewal of water, as there is in conventional machines and are characterized as having at least two semi-spherical enclosures to which water is supplied by a pump and is therein caused to circulate in a circular fashion to produce the desired water spray. Special devices are furthermore used to facilitate the easy access to various components for maintenance and cleaning.

These and further characteristics of the invention emerge from the following description, relating to preferred ways of illustrating the discovery—to give examples rather than set limits—in the figures of the drawings.

BRIEF DESCRIPTION OF THE DRAWINGS

FIG. 12 is a view from the underside of the upper portion of the modified spray mechanisms, shown separated from the lower portion;

FIG. 13 is a top plan view of the lower portion of the modified spray mechanism, shown separated from the upper portion; and FIG. 14 is an enlarged section according to XIV—XIV of FIG. 10, with portions of the inner dome cut away.

DESCRIPTION OF THE PREFERRED EMBODIMENTS

Figure 1:
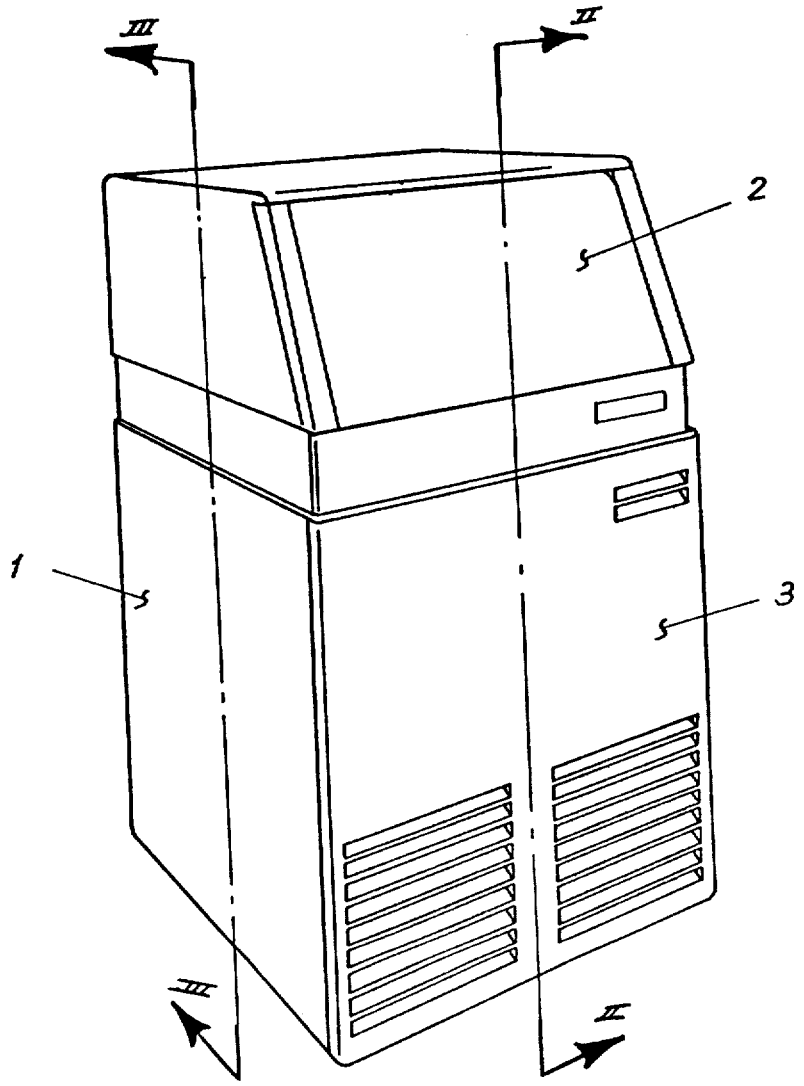
FIG. 1 illustrates a view in perspective of the entire ice making machine invented.
Figure 2:
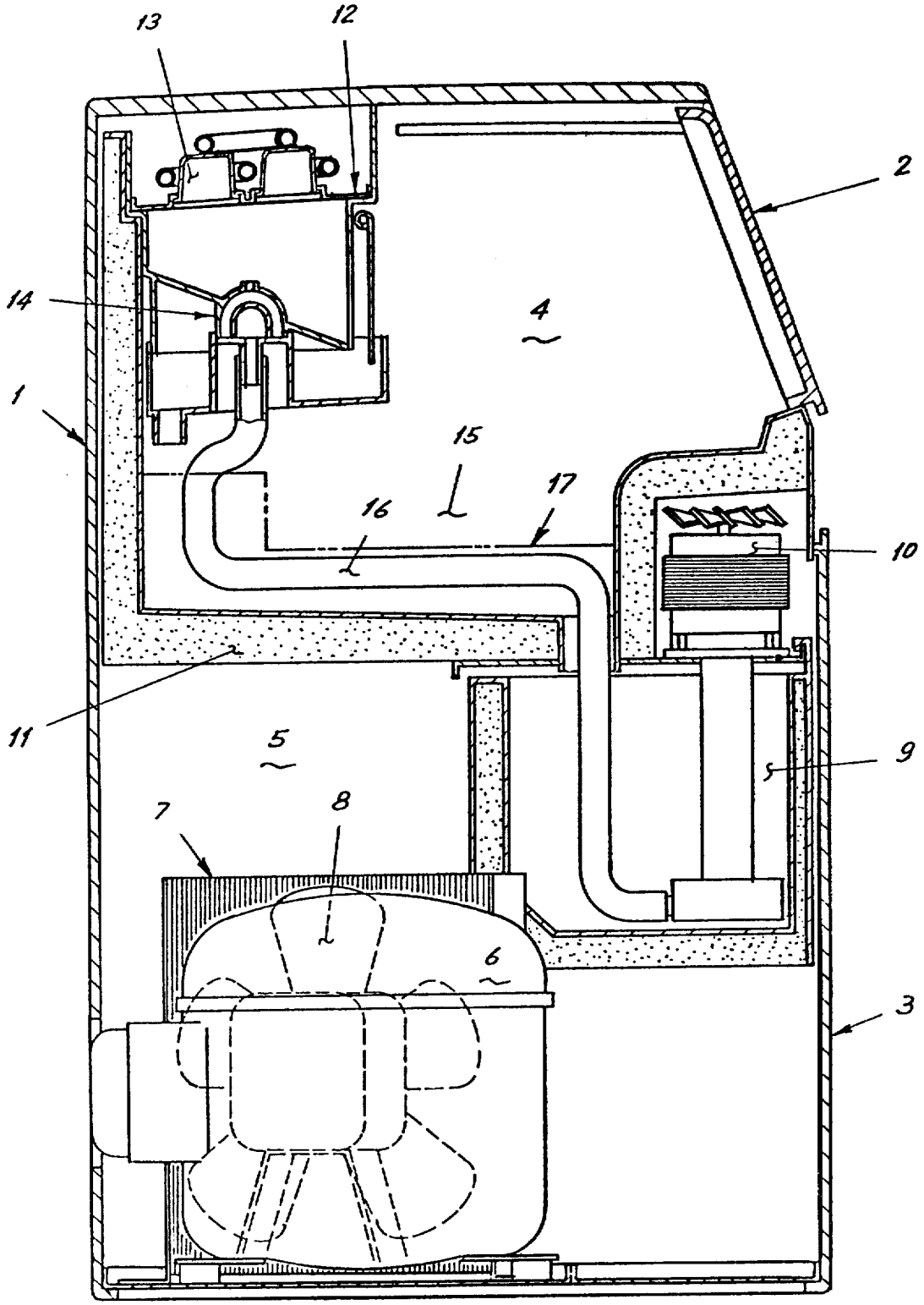
FIG. 2 illustrates a cross section according to II—II in FIG. 1.
Figure 3:
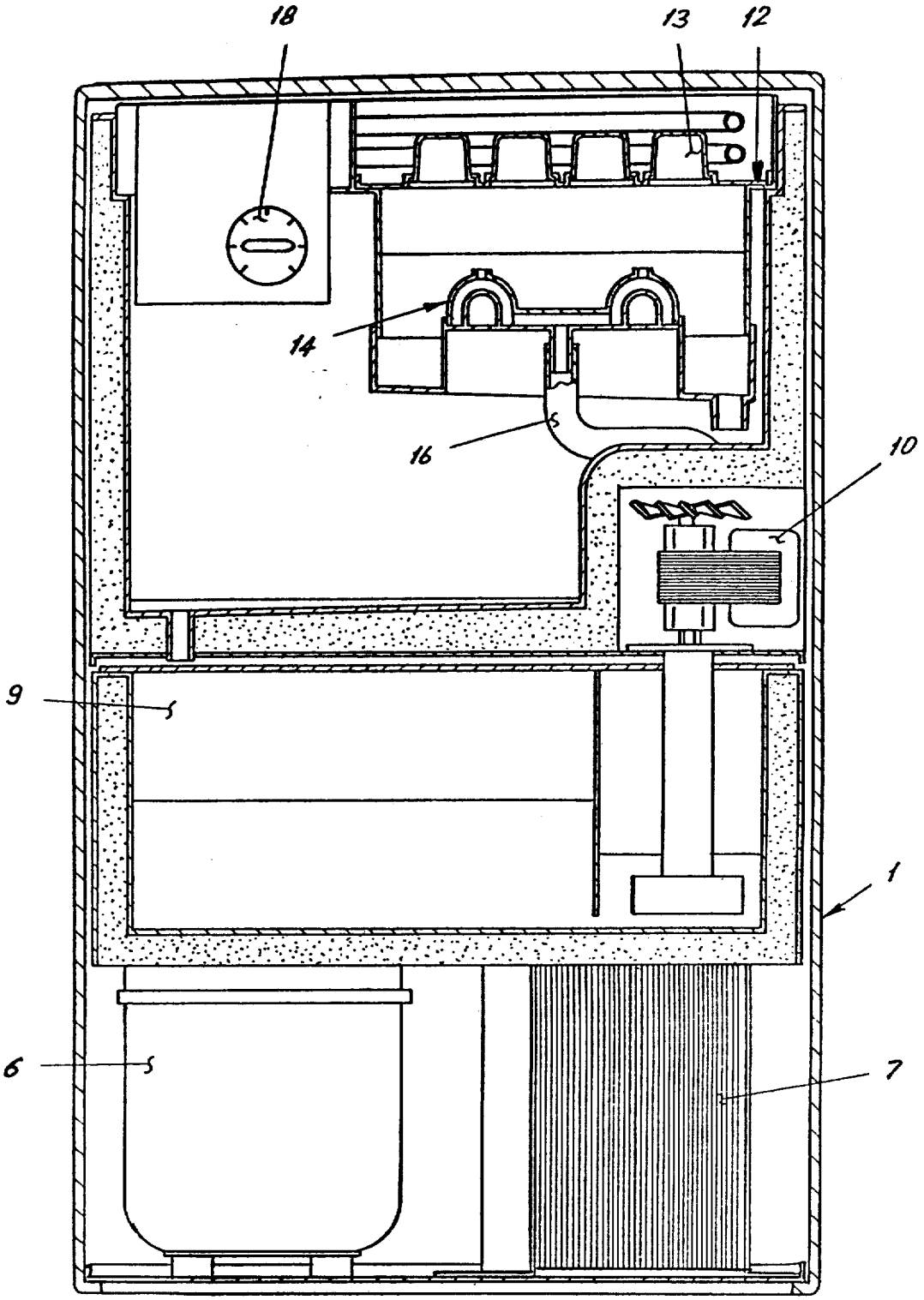
FIG. 3 illustrates a cross section according to III—III in FIG. 1.

In reference to the figures cited, the ice cube machine, according to the invention, is a compact mobile container, generically indicated at 1, having an upper small disappearing door 2 in front, as well as a small lower door 3.

The interior delimited space of the movable container 1, is divided into an upper compartment 4, thermically insulated, constituting the cell for the production and gathering of the ice cubes, and into a lower compartment, called compartments because they are accessible from the outside and the front, respectively through the small doors 2 and 3.

Within the lower compartment 5 are located the compressor 6, the condenser 7 joined to the fan 8, in themselves conventional, and also a removable water container 9 that will be described in detail later, placed so that it will be accessible from the outside, through the front of the appliance 1. In the lower compartment 5 is also the pump unit generically indicated by 10.

The upper compartment 4 is delimited by a boxlike body 11 constructed of thermically insulating material, it contains the evaporator 12, joined to a number of small inverted cups 13, to constitute the refrigerator, the spraying unit, generically indicated by 14, and it also determines the tub 15 to receive the ice cubes. The ducts 16 and 17, respectively for intake and outflow, connect the spraying unit 14 to the water container 9, the intake duct 16 being connected to the pump unit 10, immersed in the water container itself.

Figure 5:
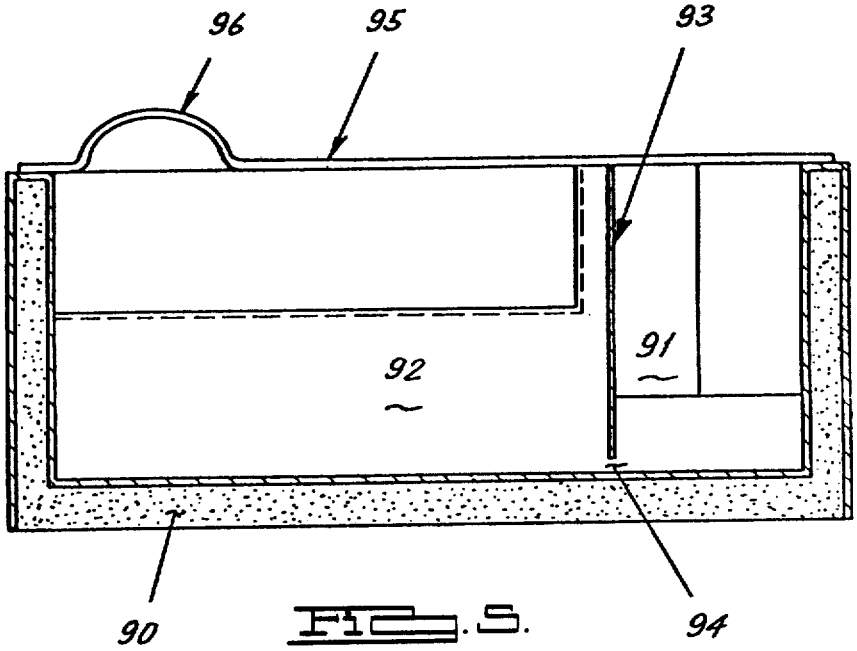
FIG. 5 illustrates a section according to V—V in FIG. 4.
Figure 4:
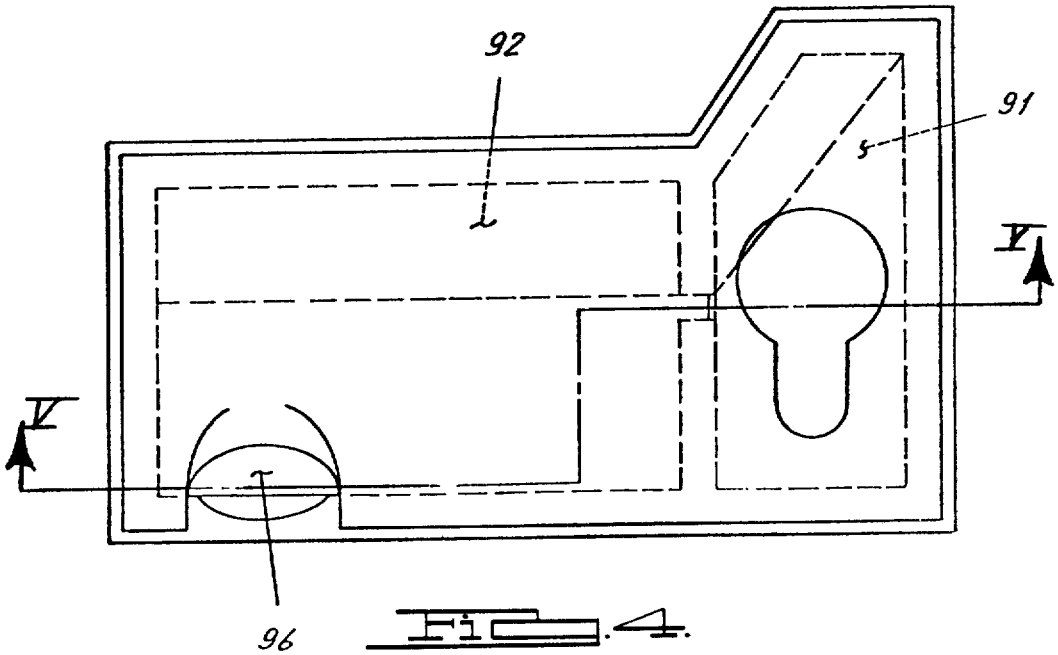
FIG. 4 illustrates a plan view of the water tank of the invention.

The water container 9, with a capacity large enough to hold a greater amount of water than that necessary for the production of one cycle of ice cubes, is illustrated in detail in FIGS. 4 and 5; this container is constructed in the form of a box 90, made of thermo insulating material, divided in two sectors respectively 91 and 92, by a diaphragm 93, also made of thermo insulating materials; the sectors 91 and 92 are intercommunicating through a small hole of communication 94, located next to the hole in the water container itself, on the diaphragm 93. Sector 91 has such a capacity that it is able to receive a quantity of water strictly necessary for a cycle of production by the machine, while sector 92 is destined to receive the rest of the water that remains. The compartment 91 has a smaller capacity that the other compartment and its size is such as to be able to contain the water strictly necessary for the correct functioning of the machine, that is a quantity substantially equal to the one needed for one freezing cycle. The feeding pump 10 floats within this small compartment 91 and puts only the water contained in it into circulation among the cups for freezing, that is that part of the water that the refrigeration group is able to cool up to about 0° C., transforming it into ice with remarkable speed. On the other hand, in practice it would be difficult if not impossible, for the cooling group, especially at the moment when the machine is stated, to cool to 0° C.and then freeze the entire body of water still at room temperature contained in the entire tank.

The water container 9 also has an upper lid 95 (visible in FIG. 5) provided with a protrusion 96, permitting the filling of the container itself with water, by means of a conventional pitcher or bottle, avoiding thus the necessity of removing the water container from its place and removing only the lower door 3. On the other hand, the possibility to remove the water container 9 allows its periodical removal with great ease for cleaning purposes with running water which is advantageous.

Figure 8:
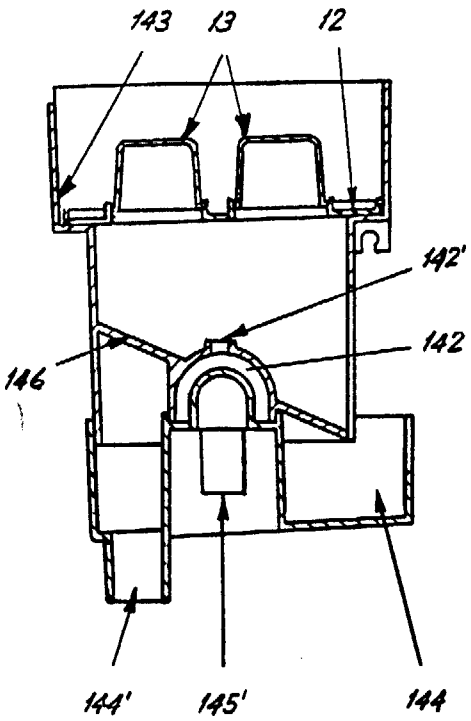
FIG. 8 illustrates the section according to VIII—VIII in FIG. 6.
Figure 6:
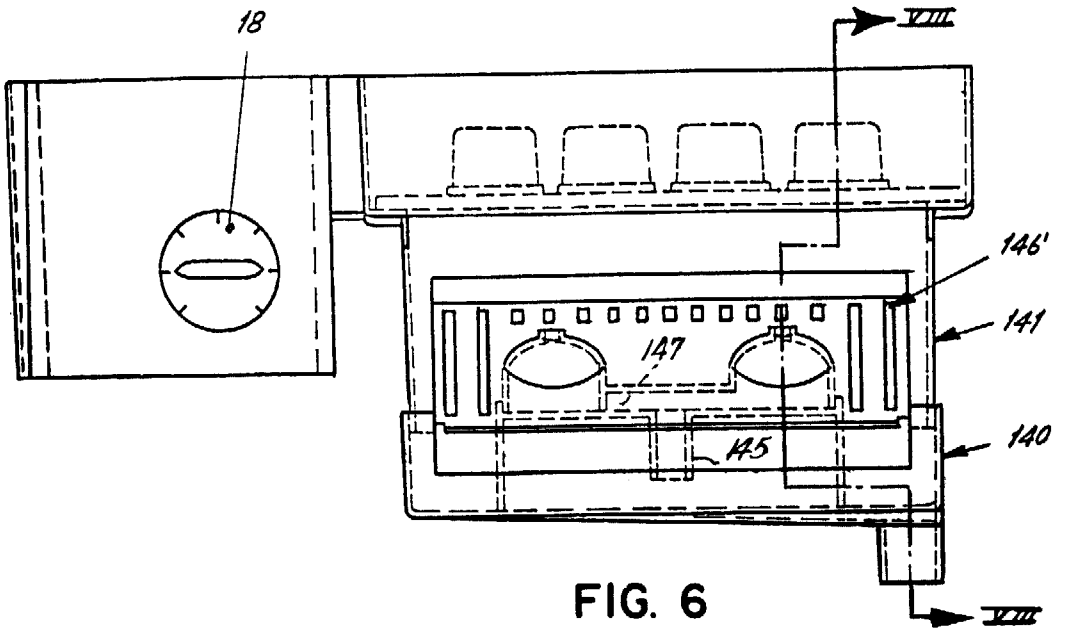
FIG. 6 illustrates in a front view the detail of the spraying and freezing unit according to the invention.
Figure 7:
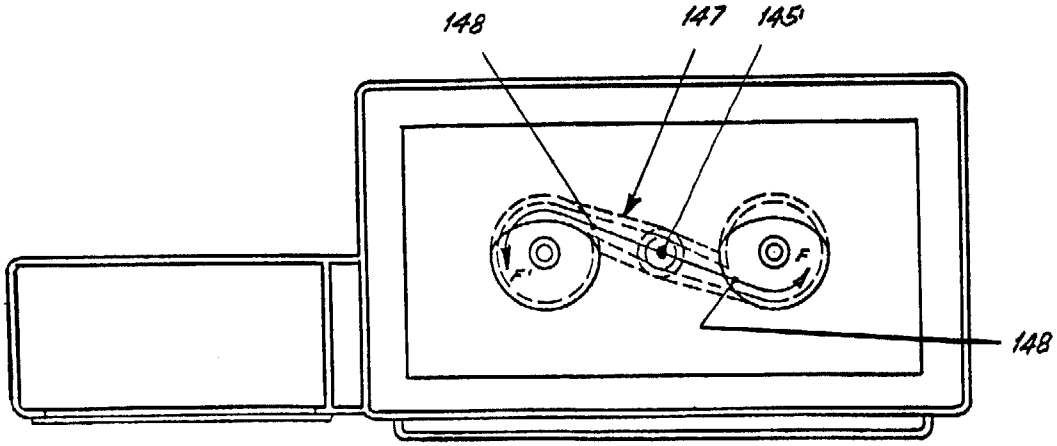
FIG. 7 illustrates the spraying unit according to the invention seen from above.

The spraying unit 14, illustrated in detail in FIGS. 6, 7 and 8, is formed by assembling a lower box of distribution and discharge 1,0 and of an upper element 141, which define between them a pair of semispheric or domelike sprayer spaces 142. The upper element 141 is also provided with an upper chamber 143 to house the evaporator 12 and the small cups 13.

The box of distribution and discharge 140, made en bloc of formed plastic, is formed in the shape of external rectangular discharge area 144, provided with a small drain orifice 144', and of an inlet duct 145 of reduced dimensions, provided with a small discharge orifice 145'.

The upper element 141, also made in one piece of molded plastic material, has three vertical walls, forming at the top a step creating the seat for the aforementioned upper chamber 143, and an inclined surface 146 presenting a number of slits 146', connecting the upper space to the discharge area 144. The two sprayer spaces 142, in the shapes of semispheric domes are each provided at the top with a cylindrical opening 142' having a considerable diameter. Passage 147 opens through ports 148, into the semispheric or dome-like spaces 142 between the lower box 140 and the upper element 141. The inlet 145 opens into an angularly entending passage 147 defined between the upper surface of the lower box 140 and the upper element 141.

It will be noted that the passage 147 is tangential with respect to the dome-like spaces and that consequently water entering the dome-like spaces through openings 149 is caused to rotate in said spaces about the axis of openings 142.

Figure 9:
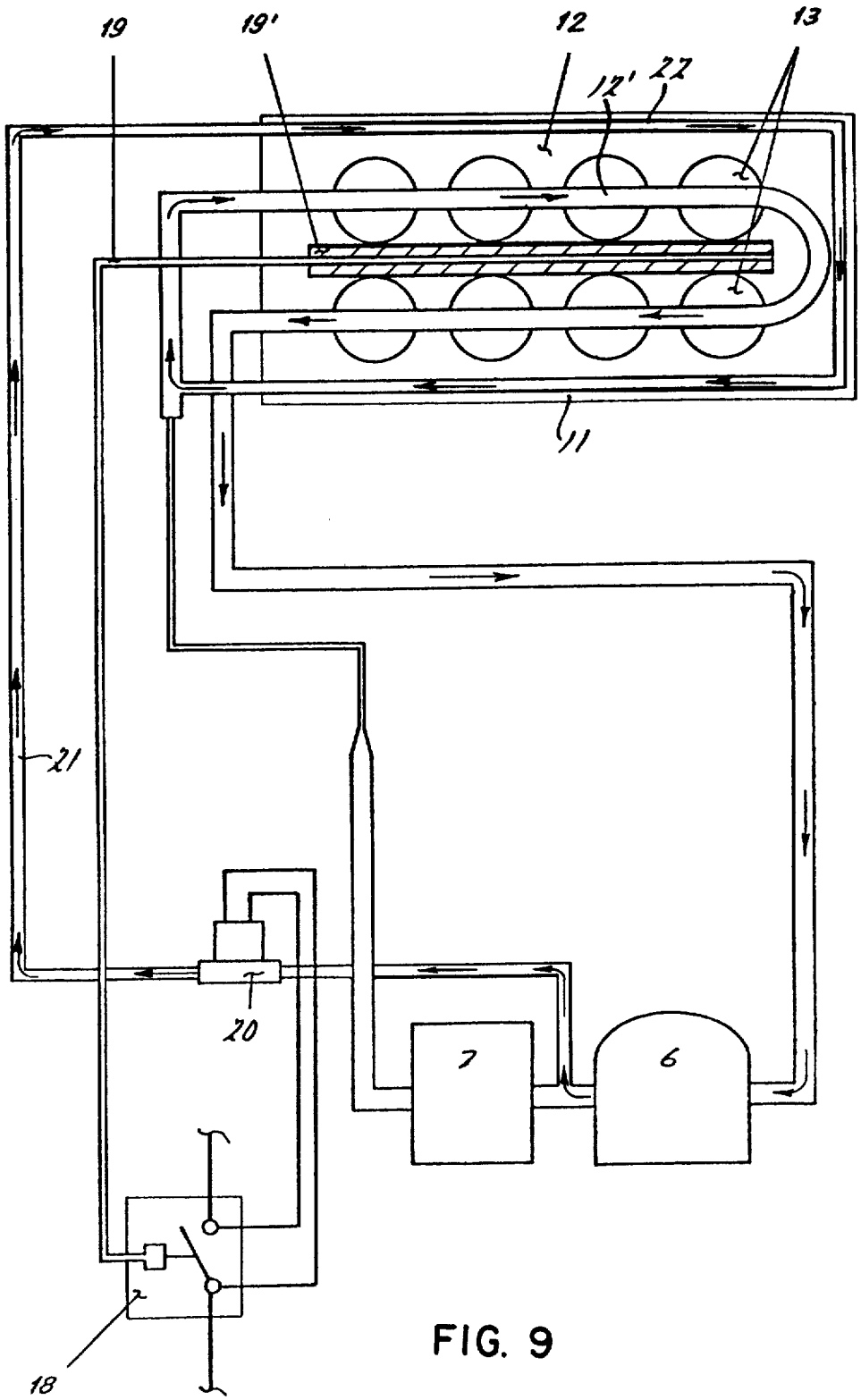
FIG. 9 illustrates in outline the regulating device of the refrigerator unit, according to the findings, in the inversion phase of the cycle.

The freezing unit, formed by joining the small copper cups 13 to the serpentine evaporator 12, is in itself of a conventional type, except that a special control is connected to it that is able to reverse the cycle of ice production, illustrated schematically in FIG. 9; a thermostat 18 is connected to a sensor 19, covered with thermically insulated material 19', set in direct contact with each one of the small copper cups 13; since it is possible to determine beforehand and empirically the temperature of the small copper cups 13 to which the complete formation of an ice cube corresponds, during a normal cycle of refrigeration. Knowing the isolating power of the material 19', it is therefore possible to preset the thermostat 18 in such a way that it will control the reversal valve of the cycle 20, predisposed to determine the dropping of the formed ice cubes, in a direct manner; thus the necessity which exists in conventional techniques, to connect a timer to the thermostat, does not exist and therefore there is a reduction in cost and a better guarantee for the correct functioning of the machine. When activated by sensor 19, thermostat 18 completes a circuit of the operating coil of valve 20, which thereupon directly connects the high side of compressor 6 to the evaporator coil 12' through passage 21 and a warming coil 22 which encircles and is joined to the floor or diaphragm of the evaporator 12. When this occurs the hot gases bypass the condenser 7 and flow, as indicated by the arrows, through the warming coil 22, and evaporator coil 12'. These actions warm both the copper cups 13 and the floor of the evaporator 12, and provide the heat necessary to ensure the release of the cubes, without requiring continued flow of water from pump 10, which may therefore, in known fashion, not illustrated, be interrupted during the harvest cycle by the aforesaid action of the thermostat 18.

The operation of the machine and its most important phases and characteristics are illustrated below:

The machine is installed by simply plugging it into the electrical circuit, without having to use any water connection: then the user removes the lower door 3, reaches the water tank 9, fills it with water through the opening 96 with a pitcher, a bottle or any other container. The machine is therefore started with a conventional electrical switch that starts the compressor 6, the fan 8 and the feeding pump 10; the conventional cycle of refrigeration is thus started, while the pump 10, immersed in sector 91 of the water container 9, feeds the water, through the duct 16, to the distribution tube 145, thanks to the presence of the passage 147 and the tangential arrangement of the openings 148, the water penetrates into the sprayer spaces 142 in the direction indicated by arrows F and F', and flows therein in a circular or whirling path. This whirling motion causes water to emerge through openings 142' in the form of a conical spray which achieves even distributions and limits the force of the sprays against the walls of the cups 23 themselves. The water not immediately frozen falls into the ring-shaped discharge box 144, through the slits 146', and is then carried through the small duct 17, into the same sector 91 of the water container 9. Continuing the cycle, the progressive forming of the ice cubes is brought about, during the separation of the water contained in sector 91 of the water container, from the left over mass of water, an acceleration of the production cycle itself is allowed, bringing about a progressive cooling off of that mass of water; however, the exchange is now made, by virtue of the principle of communicating vessels, through the connecting opening 94 between the two sectors 91 and 92 of the water container 9.

When the ice cubes are made, the thermostat 18 determines as previously illustrated, the reversal of the refrigeration cycle, in order to allow the cubes formed in the cups 13 to detach themselves, as small cubes which, sliding over the inclined surface 146, are gathered in the thermally insulated container 15. When the cubes have fallen out, sensor 19' causes the thermostat 18 to interrupt the bypass circuit through valve 20 and restart pump 10. The cycle thus begins again, and is repeated until there is no more water in the water container 9, being interrupted by a conventional hydrostat (not illustrated) conventionally furnished and immersed within the water container 9.

Referring now to the modified embodiment of the invention shown in FIGS. 10 through 14, it will be understood that except in respect to the spray mechanism the construction and mode of operation are the same as described above, and corrsponding reference characters are used to designate corresponding parts.

Figure 10:
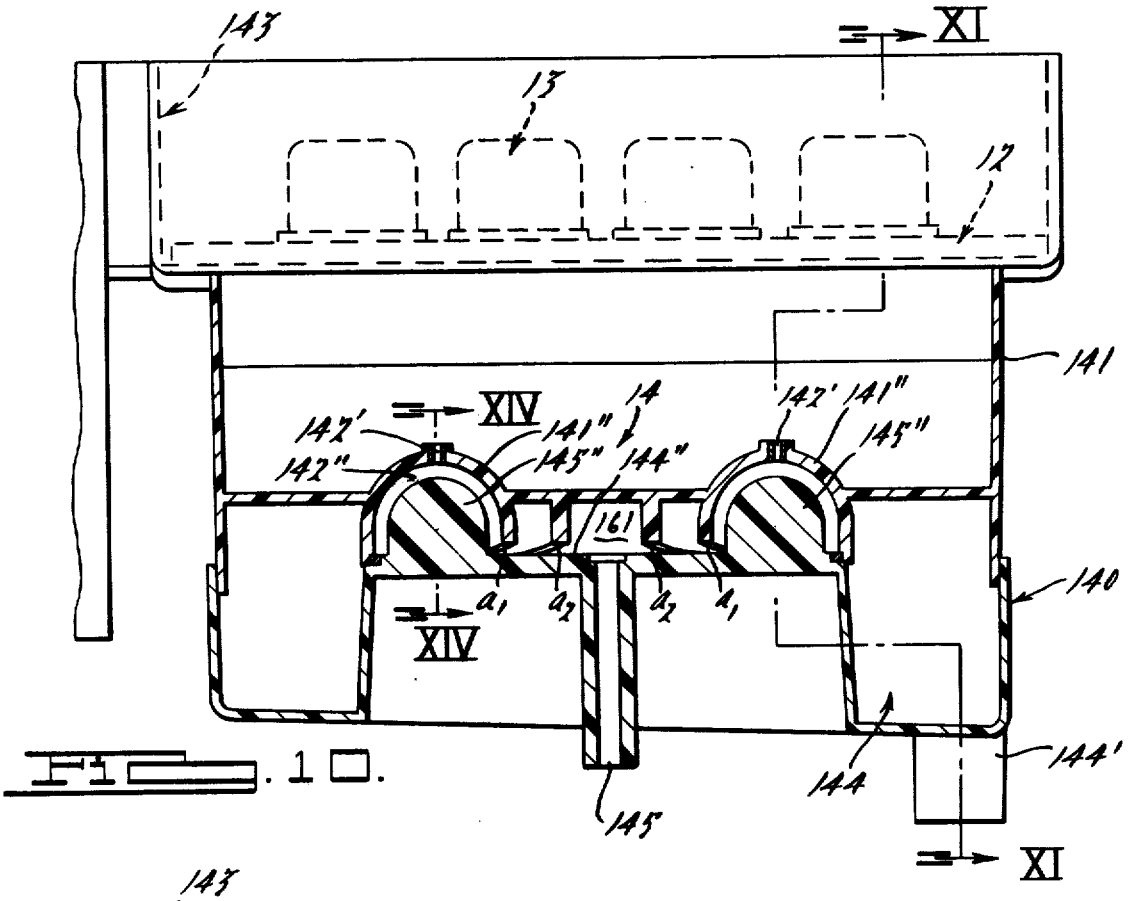
FIG. 10 is a front view, partly in section, of a modified form of spraying mechanism according to the invention.
Figure 11:
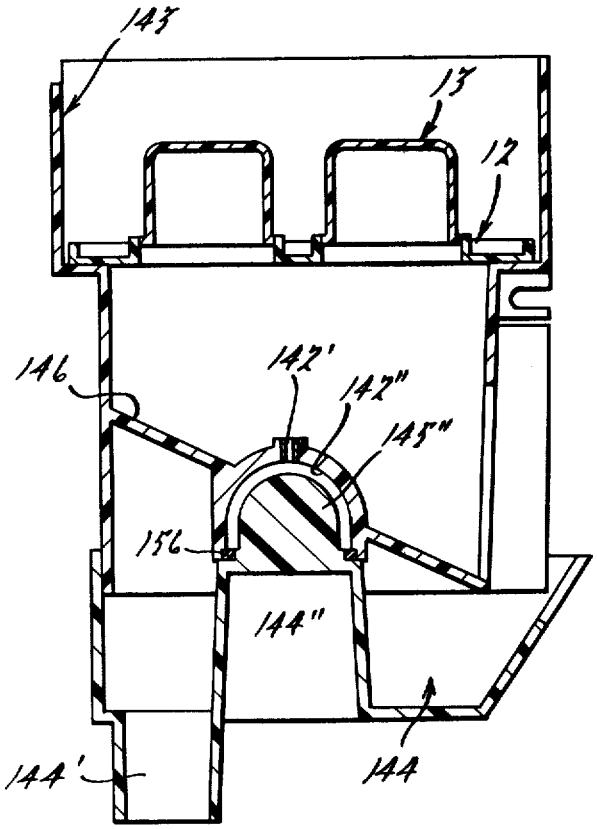
FIG. 11 is a section according to XI—XI in FIG. 10.

More particularly, as seen in FIGS. 10 and 13, the central upper surface of the lower box 140 is flat. Two semispheric domes 145" are integral with and extend upwardly from the end portions of the upper surface of box 140. The upper dome-like surfaces 141" are formed in the upper element 141 and extend over and in spaced relation to the surfaces 145" to define therewith the dome-like sprayer spaces 142". Throughout the circumferential areas marked $A_4$ in FIG. 12 the lower ends of the dome-like elements 141" rest upon and are sealingly connected to the upper surface 144" rest by conventional O-rings 156. Throughout the remainder $A_1$ of the circumferences thereof, the lower ends of surfaces 141" are progressively tapered and so become progressively spaced from the flat upper surface 144", and define therewith the progressively larger water passages 147" (FIG. 14) leading into the spaces 142" in directions generally radially thereof. The depth of these passages 147' is abruptly increased, near their deeper ends, by shoulders $A_5$ to define windows 149 which are tangential to the semispheric spaces 142".

A generally U-shaped secondary wall 160 also extends downwardly from the underside of the upper element 141 and with the adjacent surface 144" of box 140, defines the water receiving chamber 161 which contains the inlet 145. The central area of wall 160 engages surface 144". Like the lower ends of the dome-like elements 141", the surfaces $A_2$ of wall 160 are progressively tapered in directions away from the central area and define with surface 144" progressively deeper passages leading from chamber 161 into the space 142", through passages 147' and windows 149.

The functions of the two windows 149 are to create flows of water directly tangentially into the spaces 142", which with the generally radial flows through passages 147' generate helicoidal or rotary or whirling ascending movements of water within the two spaces 142" with intermittent modifications. As presently understood these intermittent modifications are caused by the combination of, and interference between the respectively tangential and radial flows of water within the 142". As a result, water emerges from the ports 142' as jets of conical form the diameters whereof intermittently enlarge and contract, thus providing substantially uniform distributions of water to the evaporator cups. These rotary flows are also very beneficial in that they scrub and prevent the accumulation of sediment upon the sprayer spaces 142".

The function of the cylindrical openings 142' calibrated experimentally, is to regulate the jet, the range of the water and the dimension of the cones.

In the embodiment of FIGS. 10–14 the upper and lower compartments 141 and 140 are releasably held together by studs 150 which are inserted from the underside of compartment 140, through apertured bosses 152, and are received in internally threaded bosses 154 provided on the upper compartment. As aforesaid, an O-ring 156 is received between the mating surfaces to prevent leakage therebetween.

The herein described embodiments are illustrative, and it will be understood that further and equivalent modifications may be made without departing from the spirit and scope of the appended claims.

What is claimed is:

1. A machine for forming ice cubes comprising, a plurality of liquid receiving cups, means for refrigerating the same to freeze a portion of water received therein, a first member having a surface for receiving cubes upon release from said cups, a second member defining a sump for excess water drained from said cups, spray mechanism comprising, an outer chamber member having a dome-like inner surface and an exit passage leading therefrom toward said cups formed on and integral with said first member, said spray mechanism further comprising an inner chamber member having a dome-like outer surface projecting into said outer chamber member and formed on and integral with said second member, and means for delivering water to said chamber and causing the same to exit from said passage toward said cups.

2. The machine of claim 1 wherein said cups are arranged in a downwardly presenting coplanar surface of an evaporator forming part of said refrigerating means.

* * * * *